United States Patent [19]

Asano

[11] 4,077,156

[45] Mar. 7, 1978

[54] TOY VEHICLE WITH ENERGY STORING MECHANISM

[75] Inventor: Kiyoji Asano, Tokyo, Japan

[73] Assignee: Shinsei Kogyo Co., Ltd., Tokyo, Japan

[21] Appl. No.: 724,075

[22] Filed: Sep. 17, 1976

[51] Int. Cl.[2] ..... A63H 29/02

[52] U.S. Cl. ..... 46/206

[58] Field of Search ..... 46/202, 206, 208, 209

[56] References Cited

U.S. PATENT DOCUMENTS

| | | | |
|---|---|---|---|
| 1,022,258 | 4/1912 | Pfeil | 46/206 |
| 3,541,725 | 11/1970 | Miura | 46/206 |
| 3,798,831 | 3/1974 | Higashi | 46/209 |

FOREIGN PATENT DOCUMENTS

| | | | |
|---|---|---|---|
| 747,034 | 3/1956 | United Kingdom | 46/209 |
| 715,303 | 9/1954 | United Kingdom | 46/206 |

*Primary Examiner*—Louis G. Mancene
*Assistant Examiner*—Robert F. Cutting
*Attorney, Agent, or Firm*—Staas & Halsey

[57] ABSTRACT

The present invention relates to a toy vehicle provided with an energy storage mechanism for propelling the vehicle. The vehicle is provided with a frame, an axle having wheels secured thereto, the axle being mounted for rotation with respect to the frame, an energy source consisting of a housing provided with a gear, a spring having one end attached to the housing and coiled within the cavity, and a second gear provided with a stem positioned within the cavity and to which the other end of the spring is attached, a gearing mechanism that is activated by the rotation of the axle in one direction to rotate the first and second gears in opposite directions to store energy in the spring by coiling same, the release of the axle thereafter releasing the stored energy causing the axle to rotate in the opposite direction to propel the vehicle. The gearing mechanism includes a ratchet for preventing the first gear from rotating after the axle is released as the vehicle is being propelled, and moveable gearing mechanisms for disengaging the aforesaid driving connections after release of the axle.

8 Claims, 5 Drawing Figures

TOY VEHICLE WITH ENERGY STORING MECHANISM

BACKGROUND AND SUMMARY OF THE INVENTION

The invention disclosed herein related to the general category of powered toy vehicles and in particular to a self-propelled vehicle wherein energy is stored by movement of the vehicle in one direction thus permitting the vehicle to be forwardly propelled merely by releasing same. Toy vehicles powered by electrical and wind-up motors are well known in the art but a need has long existed for self-propelled vehicles of the non-electrical variety which are propelled in one direction after storing energy by moving the vehicle in another direction, and wherein the foregoing may be accomplished with a construction that is characterized by simplicity and durability and which may be manufactured at low cost. The present invention employs an energy source in the form of a housing within which a coil spring is located and a system activated by the rotation of the wheels of the vehicle in one direction for coiling the spring storing energy therein until the vehicle is released at which time it is propelled forwardly by the sudden release of energy. A gearing system is employed which is capable of storing the potential energy referred to above and releasing same in such a manner as to simplify both the construction and operation of the vehicle and as well to permit the vehicle to be played with independently of the energy storing mechanism previously described.

DESCRIPTION OF THE PREFERRED EMBODIMENT

Figure 1:
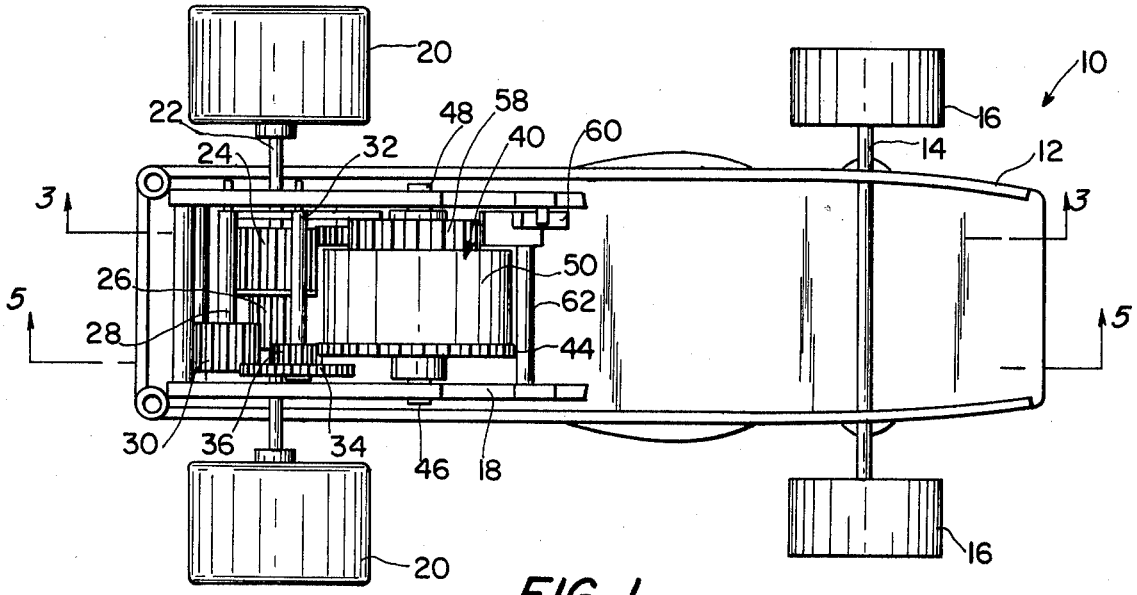
FIG. 1 is a top plan view of the toy vehicle of the present invention illustrating the relationship of the energy storing spring mechanism and the gearing systems associated therewith.

The toy vehicle of the present invention is designated generally by the reference numeral 10 in FIG. 1 and consists of the vehicle chassis 12 to which the front axle 14 and the front wheel 16 are appropriately mounted.

The motor and gearing mechanisms described in detail hereinafter are mounted within a chassis designated by the reference numeral 18 which is appropriately mounted to the vehicle chassis 12.

The rear wheels 20 and the rear axle 22 are appropriately mounted to the vehicle and motor chassis 12 and 18, respectively. Fixedly secured to the rear axle 22 are gears 24 and 26, illustrated in detail in FIG. 2.

Suitably journalled for rotation within the sidewalls of the motor chassis 18 is a shaft 28 provided at one end thereof with a gear 30 which engages gear 26. Also suitably journalled for rotation with respect to the sidewalls of the motor chassis 18 is a shaft 32 which includes at one end thereof gears 34 and 36. The ends of the shaft 32 are mounted within somewhat elongated slots 33. It will be apparent that gear 34 is positioned in meshing relationship with gear 30 but because of the slightly elongated slots 33 may move out of engagement with gear 30, as described in detail hereinafter.

Figure 2:
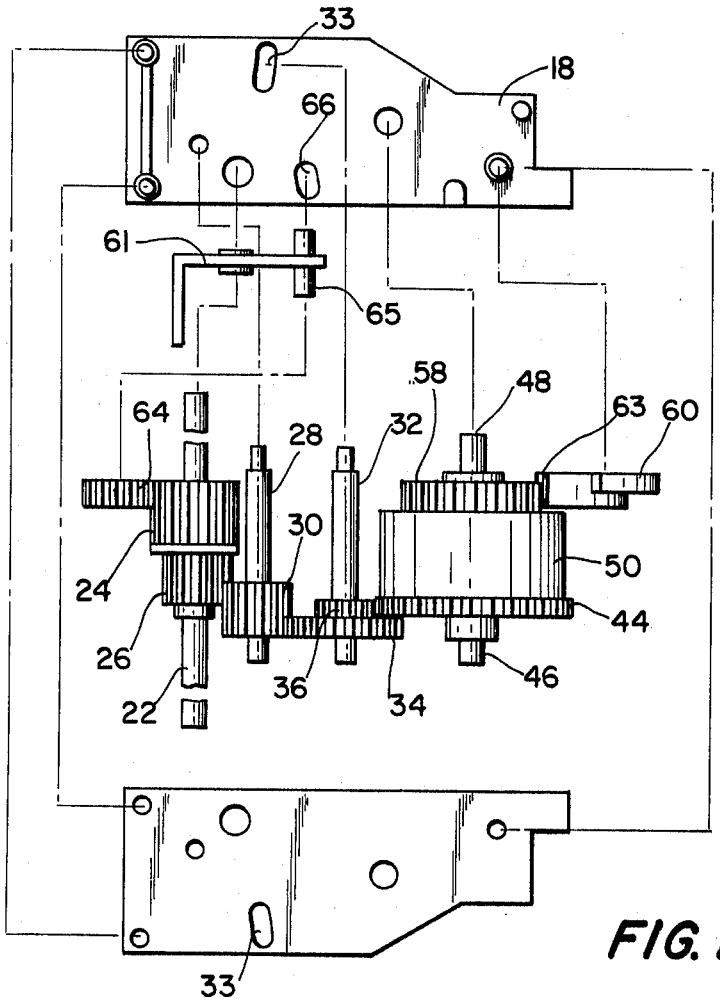
FIG. 2 is an exploded top plan view of the energy storing spring and gear mechanisms and their relationship to the motor chassis which is mounted within toy vehicle.
Figure 4:
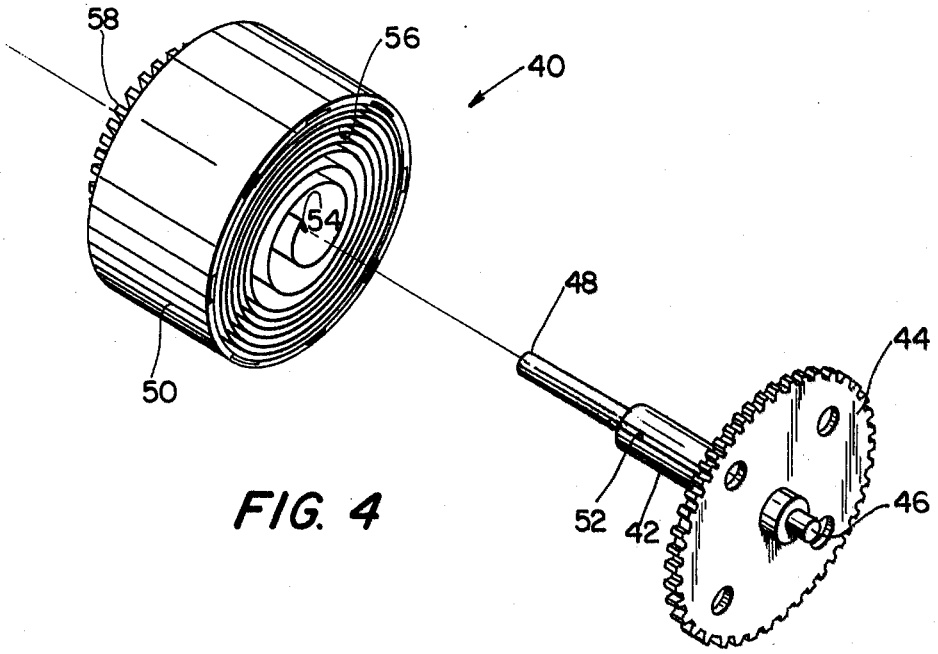
FIG. 4 is an exploded perspective view illustrating the components of the energy storing spring mechanism.

The spring-loaded driving mechanism is designated generally by the reference numeral 40 in FIG. 4 and consists of a shaft 42 onto which is mounted a gear 44. It will be apparent that the end 46 of the shaft 42 is suitably mounted within one of the sidewalls of the motor chassis 18 for rotation. The other end 48 of the shaft 42 passes through an opening (not shown) in the drum 50 and is journalled within the other wall of the motor chassis 18. The centralmost portion of the shaft 42 is provided with slots 52 on either side thereof within which the curvillinear end portion 54 of the spring 56 is locked. It will be apparent that the spring 56 may be coiled within the housing 50 such that it is possible upon releasing the coiled spring 56 to cause the shaft 42 and the gear wheel 44 associated therewith to rotate. As illustrated in FIGS. 1–2, the gear 44 engages the gear 36. Finally, the gear designated by the reference numeral 58 is affixed to the end of the drum 50 through which the end 48 of the shaft 42 passes.

A ratchet mechanism 60 is mounted for rotation about the post 62 which, as illustrated in FIG. 1, connects the sidewalls of the motor chassis 18, and is provided with teeth 63 which engage the teeth of the gear 58, the purpose of which will be explained in detail hereinafter.

Figure 3:
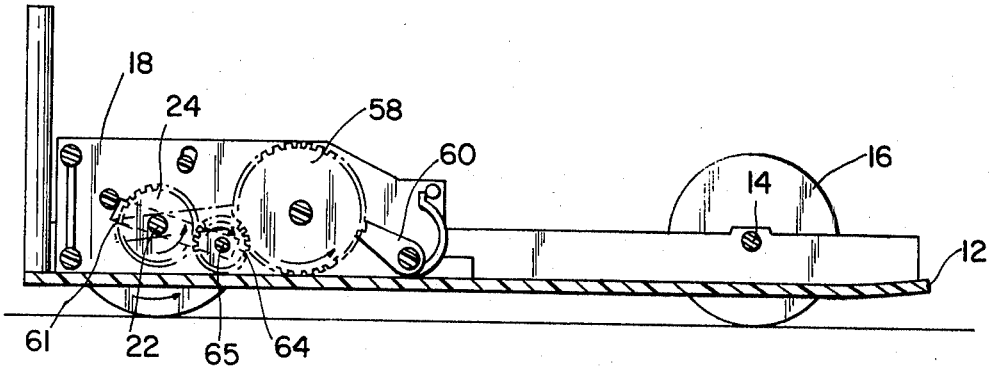
FIG. 3 is a sectional view taken along line 3—3 of FIG. 1 illustrating the relationship of certain of the gear mechanisms and as well the ratchet mechanism responsible for permitting the housing within which the spring is located to move only in one direction.

As illustrated in FIG. 3, a bar 61 is provided with an opening through which the rear axle 22 extends and is also provided at one end thereof with a leg 65 about which a gear 64 is freely mounted for rotation. It will be apparent from FIG. 3 that the gear 64 always meshes with the gear 24 and is arranged, as explained in detail hereinafter, to mesh with the gear 58. As can be seen in FIG. 2, the wall of the motor chassis 18 adjacent leg 61 is provided with a somewhat elongated slot 66 within which one side of the leg 65 extends. It will therefore be apparent that since the leg 65 is mounted for rotation about the rear axle 22, and is confined for movement within the elongated slot 66, the gear 64 is thus capable of a small degree of rotation permitting the gear 64 to move in and out of engagement with the gear 58, the purpose of which will be described in detail hereinafter.

The operation of the toy vehicle of the present invention will now be described. It will be apparent from FIGS. 1 and 3 that as the vehicle 10 is moved backwardly along a surface, the rear wheels 20 rotate in a counter-clockwise direction. This counter-clockwise rotation of the rear axle 22 causes the gear 24 to also rotate in a counter-clockwise direction. The counter-clockwise movement of the gear 24, which meshes with the gear 64, causes the gear 64 to turn in a clockwise direction and in addition thereto forces the bar 61 to rotate about the rear axle 22 forcing the gear 64 to move into engagement with the gear 58. The gear 58 and the drum 50 attached thereto are thereby caused to rotate in a counter-clockwise direction, this winding motion being irreversible in view of the ratchet mechanism 60.

Figure 5:
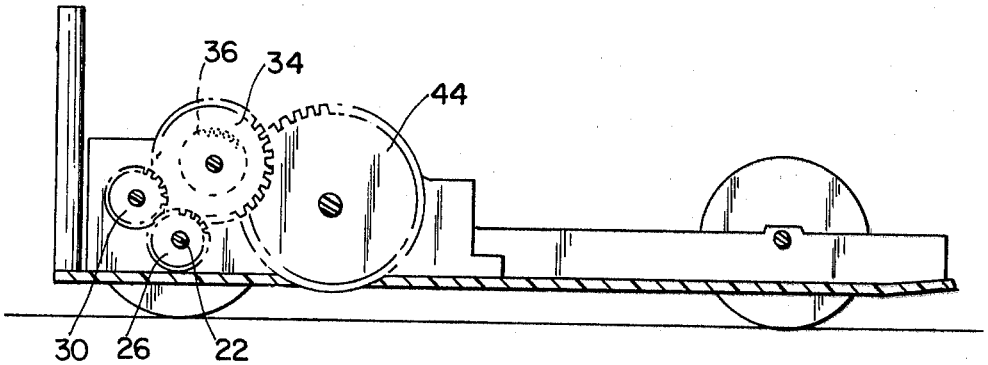
FIG. 5 is a sectional view taken along line 5—5 of FIG. 1 illustrating other parts of the gear mechanisms.

It will also be apparent from FIG. 5 that as the rear axle 22 is caused to rotate counter-clocking as a result of the vehicle being pushed backwardly, the gear 26 also rotates counter-clockwise and meshes with the gear 30 causing same to rotate in a clockwise direction. The gear 30 meshes with the gear 34 causing same to turn clockwise which action in turn results in the gear 36, which meshes with the gear 44, causing the gear 44 to rotate clockwise. It is apparent, therefore, that as a result of moving the vehicle backwardly the gear 44 and the shaft 42 attached thereto are rotated in one direction whereas the gear 58 and the drum 50 are rotated in the opposite direction, the result of which is to wind the coil spring 56. As long as the vehicle 10 is maintained against the surface on which it is to run the motor remains in its energized state. Thereafter, the vehicle 10 is released at which time the spring 56 during the process of uncoiling vigorously causes the shaft 42 and the gear 44 to rotate counter-clockwise. The counter-clockwise rotation of the gear 44 which engages the gear 36 causes the shaft 32 and the gear 34 to rotate clockwise. Since the gears 34 and 30 mesh with each other the clockwise rotation of the gear 34 results in the gear 30 and the shaft 28 rotating counter-clockwise. In similar manner, since the gears 30 and 26 mesh with each other, the counter-clockwise rotation of the gear 30 imparts a clockwise rotation to the gear 26 causing the rear axle 22 to rotate in a clockwise direction in turn causing the rear wheels 20 to rotate clockwise propelling the vehicle 10 along its intended path. It will be further apparent that since the ends of the shaft 32 are mounted within the slots 33 within the sidewalls of the motor chassis 18, and since the stored energy of the coiled spring 56 is abruptly released, the result is that the shaft 32 rides upwardly within the slots 33 resulting in the gears 30 and 34 becoming disengaged such that the vehicle 10 may be moved along the ground by the child without interference between the gears 30 and 34. But upon backward movement of the vehicle 10 for purposes of storing energy in the coil spring 56 it will be apparent that the clockwise rotation of the gear 30 results in the teeth of the gear 30 engaging the mating teeth of the gear 34 resulting in the shaft 32 being moved downwardly within the slots 33 for rewinding the engine. It will be still further apparent that after the stored energy is released, the gear 64 moves out of engagement with gear 58 as a result of the leg 65 rotating about the rear axle 22. Disengagement of the gears 30, 34 and 64, 58 permits the vehicle 10 to be played with, i.e. moved forwardly by hand along the surface, independently of the motor operation as described above.

I claim:

1. A toy vehicle, comprising:

a frame;

first and second axles with wheels for supporting said vehicle secured thereto, and means mounting said first and second axles for rotation with respect to said frame;

energy source means mounted to said frame;

means connected to and activated by the rotation of said first axle in one direction for activating said energy source means to store energy therein, said energy that has been stored being thereafter released by releasing the vehicle causing said first axle to rotate in the opposite direction propelling the vehicle; and wherein said means for activating also disengages said first axle from said energy source means so as to be free wheeling in said opposite direction when said energy source means has released all of said stored energy.

2. A toy vehicle as in claim 1, wherein said energy source means comprises:

a housing provided with a first gear;

a spring having one end attached to said housing and coiled within cavity in said housing; and a second gear provided with a stem positioned within said cavity, the other end of said spring being attached to said stem.

3. A toy vehicle as in claim 2, wherein said means for activating said energy source means comprises means for rotating said first and second gears in opposite directions as said axle is rotated in said one direction.

4. A toy vehicle as in claim 3, including means preventing said second gear from rotating as the vehicle is released.

5. A toy vehicle as in claim 3, wherein said means for rotating said first and second gears in opposite directions as said first axle is rotated comprises:

a third gear mounted on said first axle, and means operatively connecting said third gear to said first gear; and a fourth gear connected to said first axle, and means operatively connecting said fourth gear to said second gear.

6. A toy vehicle as in claim 5, wherein said means operatively connecting said third gear to said first gear comprises a fifth gear, means mounting said fifth gear to move between a first position wherein said fifth gear engages said third and first gears and the second position wherein said fifth gear engages only said third gear.

7. A toy vehicle as in claim 6, wherein said means operatively connecting said fourth gear to said second gear comprises a sixth gear mounted for rotation and engaging said fourth gear, a seventh gear, and means mounting said sixth and seventh gears to move between a first position wherein said seventh gear engages said second gear and said sixth gear engages said fourth gear and a second position wherein said seventh gear engages only said second gear.

8. A toy vehicle as in claim 4, wherein said means preventing said first gear from rotating as the vehicle is released comprises a ratchet mechanism mounted for rotation with respect to said frame and having one end thereof engaging said first gear.

* * * * *